US005110627A

United States Patent [19]

Shoesmith et al.

[11] Patent Number: 5,110,627

[45] Date of Patent: May 5, 1992

[54] PROCESS FOR MAKING REINFORCEMENTS FOR ASPHALTIC PAVING

[75] Inventors: Roy Shoesmith; Mark O. Kittson, both of Ontario, Canada

[73] Assignee: Bay Mills Limited, Ontario, Canada

[21] Appl. No.: 745,970

[22] Filed: Aug. 12, 1991

Related U.S. Application Data

[60] Continuation of Ser. No. 558,153, Jul. 26, 1990, abandoned, which is a division of Ser. No. 116,351, Nov. 4, 1987, Pat. No. 4,957,390.

[51] Int. Cl.[5] ..... B05D 5/10

[52] U.S. Cl. ..... 427/208.4; 52/309.13; 52/309.16; 427/208.8; 427/407.1; 427/407.3; 427/412.1

[58] Field of Search ..... 52/309.13, 309.16; 427/208.4, 208.8, 407.1, 407.3, 412.1

[56] References Cited

U.S. PATENT DOCUMENTS

| | | | |
|---|---|---|---|
| 2,115,667 | 4/1938 | Ellis | 404/70 |
| 2,139,816 | 12/1938 | Fordyce | 404/70 |
| 2,811,906 | 11/1957 | Chappell | 404/73 |
| 3,344,608 | 10/1967 | McEachran | 404/70 X |
| 3,547,674 | 12/1970 | Draper et al. | 404/489 X |
| 3,557,671 | 1/1971 | Vasiloff | 404/28 X |
| 3,581,631 | 6/1971 | Samson et al. . | |
| 3,741,856 | 6/1973 | Hurst | 161/88 |
| 3,770,559 | 11/1973 | Jackson . | |
| 3,788,879 | 1/1974 | Waysman . | |
| 3,900,102 | 8/1975 | Hurst | 206/411 |
| 4,168,924 | 9/1979 | Draper et al. | 404/70 |
| 4,169,822 | 10/1979 | Kutch et al. | 260/27 BB |
| 4,174,992 | 11/1979 | Fujii et al. | 156/244.11 |
| 4,219,603 | 8/1980 | Thun | 428/489 X |
| 4,273,685 | 6/1981 | Marzocchi et al. | 260/28.5 R |
| 4,291,086 | 9/1981 | Auten | 428/489 X |
| 4,332,705 | 6/1982 | Uffner | 523/206 |
| 4,362,780 | 12/1982 | Marzocchi et al. | 428/489 X |
| 4,368,228 | 1/1983 | Gorgati | 428/489 X |
| 4,440,816 | 4/1984 | Uffner | 428/40 |
| 4,451,171 | 5/1984 | Uffner et al. | 404/31 |
| 4,472,086 | 9/1984 | Leach | 404/70 X |
| 4,478,912 | 10/1984 | Uffner et al. | 428/349 |
| 4,556,464 | 12/1985 | St. Clair | 524/274 X |
| 4,595,636 | 6/1986 | Wiercinski et al. | 428/489 |
| 4,699,542 | 10/1987 | Shoesmith | 404/82 |

FOREIGN PATENT DOCUMENTS

| | | |
|---|---|---|
| 1217374 | 2/1987 | Canada . |
| 0199827 | 11/1986 | European Pat. Off. . |
| 1759133 | 6/1971 | Fed. Rep. of Germany . |

OTHER PUBLICATIONS

"Roadglas", Owens Corning fiberlgas, Highway Products, Road Repair System, Oct. 1982, pp. 1 through 8.

"Roadglas", Owens Corning Fiberlgas, Highway Products, Road Repair System, Jan. 1983, pp. 1 through 8.

"GlasGrid", Bay Mills Limited, Mar. 1986, pp. 1 and 2.

Lytton et al., "Reinforcing Fiberglass Grids for Asphalt Overlays," May 1986, pp. 1 through 51.

Lytton, "Reinforcing Fiberglass Grids for Asphalt Overlays," Jul. 1988, pp. 1 through 23.

Shoesmith, "Reinforcement of Asphalt Overlays," Nov. 1988, pp. 1 through 13.

*Primary Examiner*—Michael Lusignan

*Attorney, Agent, or Firm*—Fitzpatrick, Cella, Harper & Scinto

[57] ABSTRACT

Disclosed is a process for making a reinforcement for asphaltic paving. The process includes selecting an open grid including two sets of parallel strands of continuous filament fibers, the grid having openings between adjacent strands and the two sets of strands being substantially perpendicular to each other, impregnating the strands of the grid with a resin and applying to one side of the resin-impregnated grid a coating of stable, activatable adhesive without closing the openings between the strands, the adhesive being compatible with asphaltic paving.

26 Claims, No Drawings

PROCESS FOR MAKING REINFORCEMENTS FOR ASPHALTIC PAVING

This application is a continuation of prior application, Ser. No. 07/558,153 filed Jul. 26, 1990, now abandoned, which application is a divisional of prior application, Ser. No. 07/116/351 filed Nov. 4, 1987, now U.S. Pat. No. 4,957,390.

BACKGROUND OF THE INVENTION

1. Field of the Invention

This invention relates to prefabricated reinforcements for asphaltic pavings and primarily to prefabricated reinforcements incorporated in asphaltic concrete overlays used to repair cracked pavings. Typically an underlying paving, either new or in need of repair, is covered with a liquid asphaltic tack coat. After the tack coat has partially cured, the reinforcement is laid on top of it. Finally, an overlying layer of asphaltic paving is applied on top of the reinforcement. This invention also relates to processes for making and using such reinforcements.

2. Description of the Prior Art

Various methods and composites for reinforcing asphaltic roads and overlays have been proposed. Some have used narrow strips (4 to 44 inches wide) of a loosely woven fabric made of flexible fiberglass roving (weighing 24 ounces per square yard) in the repair of cracks in pavement. These are not impregnated with resin prior to being laid on the pavement, and do not have grid-like openings. They are laid down on top of an asphalt tack coat, followed by application of asphaltic concrete, but they are too expensive and too flexible to be practical to lay over substantial portions of a roadway and, because of their flexibility, would be difficult to handle if installed over substantial portions of a road where they would be subjected to traffic from paving vehicles and personnel as the overlayment is put down. Also, the essentially closed nature of the fabric prevents direct contact between underlayment and overlying asphaltic layers, which may lead to slippage between the two layers.

Some in the prior art have used rigid plastic grids. These have the disadvantage that they cannot be continuously unrolled and are therefore difficult to install, and while they may use fiberglass as a filler for the plastic, they do not have the strength or other desirable characteristics of continuous filament fiberglass strands.

A European patent application, publication No. 0199827, date of publication Nov. 5, 1986, by the present inventor and assigned to the same assignee, describes glass grids impregnated with asphaltic resins, but without any adhesive coating. In order to use those grids, an asphaltic tack coat must first be applied to the roadway. The tack coat is applied as a liquid (for example, as an emulsion by spraying), and thereafter changes from a liquid to a solid—that is, it cures. Before the tack coat is fully cured, the grid is laid on the tack coat. The tack coat partially dissolves and merges with the impregnating resin in the grid. As the tack coat cures further, it holds the grid in place on the underlying pavement. An asphaltic cement or concrete may then be applied on top of the tack coat and the rid. Tack coats have several highly desirable features for use with such reinforcements. In particular, they are completely compatible with the asphaltic concrete or cement to be used as the overlay, and equally important, their fluid nature makes them flow into, and smooth out, rough paving surfaces.

On the other hand, tack coats present several difficulties. The properties of tack coats are very sensitive to ambient conditions, particularly temperature and humidity. These conditions may affect cure temperature, and in severe conditions, they can prevent cure. In less severe circumstances, the overlay paving equipment must wait until the tack coat has cured, causing needless delays. For example, tack coats are normally emulsions of asphalt in water, often stabilized by a surfactant. To manifest their potential, the emulsion must be broken and water removed to lay down a film of asphalt. The water removal process is essentially evaporation, which is controlled by time, temperature and humidity of the environment. Frequently the environmental conditions are unfavorable, resulting in inefficient tacking or unacceptable delay.

Tack coats complicate the paving procedure in other ways as well. Not only because they require an extra-step at the paving site, but also because tack coats are generally difficult to work with. Their ability to hold the grid to the underlying paving is relatively short-lived. Moreover, vehicle tires and footwear can transfer tack coat to nearby roads, and thereby to carpets and floors.

SUMMARY OF THE PRESENT INVENTION

The prefabricated reinforcement of this invention is an open grid of strands of continuous filaments, preferably glass. The grid is resin-impregnated and coated with certain selected activatable adhesives before it is laid on an underlying paving surface. The adhesive is selected to have a specific balance of properties over a broad range of temperatures such that the grid can (a) be stored for extended periods, (b) be unrolled on the underlying paving, (c) be held in place by the adhesive, and (d) receive the application of an asphaltic mixture overlay.

The reinforcement of this invention is easier to apply, more economical, and gives better results than previous reinforcements. Furthermore, it overcomes many of the problems previously associated with the use of tack coats.

When impregnated and coated with adhesive, the grid of this invention is preferably semi-rigid and can be rolled-up on a core for easy transport as a prefabricated continuous component to the place of installation, where it may readily be rolled out continuously for rapid, economical, and simple incorporation into the roadway. For example, it can be placed on rolls 15 feet wide containing a single piece 100 yards or more long. Alternatively, the road may be covered by several narrower strips, typically each five feet wide. It is therefore practical to use this grid on all or substantially all of the pavement surface, which is cost effective because of reduced labor. It can also be used to reinforce localized cracks, such as expansion joints.

At the paving site the grid is unrolled and laid in the underlying paving. If the adhesive is pressure sensitive, pressure is applied by a brush incorporated into the applicator, followed if necessary or desired by conventional rolling equipment. The brushes may be planar and made of bristle. They may also be loaded to increase force on the grid and create pressure to activate a pressure sensitive adhesive.

The grids of this invention, though semi-rigid, tend to lie flat. They have little or no tendency to roll back up after having been unrolled. This is believed to be due to the proper selection of resin and the use of multifilament reinforcing strands, preferably of glass, in the grid.

Once the reinforcement of this invention has been rolled out and adhered to an underlayment layer or paving, and before any overlay is placed on top of the reinforcement, the grid is sufficiently stable and fixed to the underlayment that it resists the action of workmen walking on it, construction vehicles traveling over it, and particularly the movement of the paving machine over it. This is highly important to the strength of the paving. Any raised portion in the rid, or sideways distortions of the strands, tends to reduce the strength of the reinforcement or adversely affect the smoothness of the paved surface. The reinforcement is most effective when its strands are straight and uniaxial and each set of strands lies in its own plane. The reinforcement is preferably oriented in two principal directions, longitudinally down the road and transversely across it, with one of its two sets of parallel strands running longitudinally and the other running transversely.

If the adhesive used is a pressure sensitive adhesive, it may be activated by applying pressure to the surface of the grid. Also if the adhesive is pressure sensitive, substantial force may be required to unroll the grid; it may be necessary to use a tractor or other mechanical means.

It has been found that, notwithstanding the substantial differences between the properties and behavior of the adhesives of this invention and the asphaltic tack coats of the prior art, no tack coat or other means is required to hold the grid in place while the paving overlay is placed on top of it, thereby simplifying and speeding up the paving process. It is also possible, through proper selection of adhesive, to provide far stronger binding of the grid to the underlying pavement than a tack coat. A tack coat may be used, however, if desired for other reasons.

The large grid openings permit the asphalt mixture to encapsulate each strand of yarn or roving completely and permit complete and substantial contact between underlying and overlaid layers. This permits substantial transfer of stresses from the pavement to the glass fibers. The product has a high modulus and a high strength to cost ratio, its coefficient of expansion approximates that of road construction materials, and it resists corrosion by materials used in road construction and found in the road environment, such as road salt.

Incidentally, the words "pavings", "roads", "road ways" and "surfaces" are used herein in their broad senses to include airports, sidewalks, driveways, parking lots and all other such paved surfaces.

The grid of this invention may be formed of strands of continuous filament glass fibers, though other high modulus fibers such as polyamide fibers of poly(p-phenylene terephthalamide), known as Kevlar® may be used. ECR or E glass rovings of 2200 tex are preferred, though one could use weights ranging from about 300 to about 5000 tex. These strands, which are preferably low-twist (i.e., about one turn per inch or less), are formed into grids with rectangular or square openings, preferably ranging in size from ¾" to 1" on a side, though grids ranging from ⅛" to six inches on a side may be used. The grids are preferably stitched or otherwise fixedly connected at the intersections of the crosswise and lengthwise strands. This connection holds the reinforcement in its grid pattern, prevents the strands from spreading out unduly before and during impregnation, and preserves the openings, which are believed to be important in permitting the overlayment to bind to the underlying layer and thereby increase the strength of the final composite.

The fixed connections at the intersections of the grid also contribute to the strength of the grid because they permit forces parallel to one set of strands to be transferred in part to the other set of parallel strands. At the same time, this open rid construction makes possible the use of less glass per square yard and therefore a more economical product; for example, we prefer to use a grid of about 8 ounces per square yard, though 4 to 18 ounces per square may be used, but some prior art fabrics had fabric contents of about 24 ounces of glass per square yard.

While we prefer stitching grid intersections together on warp-knit, weft-insertion knitting equipment using 70 to 150 denier polyester, other methods of forming grids with fixedly-connected intersections may be utilized. For example, a non-woven rid made with thermosetting or thermoplastic adhesive may provide a suitable grid.

Once the grid is formed, and before it is laid in place on paving, a resin, preferably an asphaltic resin, is applied. That is to say, the grid is "pre-impregnated" with resin.

The viscosity of the resin is selected so that it penetrates into the strands of the grid. While the resin may not surround every filament in a glass fiber strand, the resin is generally uniformly spread across the interior of the strand. This impregnation makes the grid compatible with asphalt, imparts a preferable semi-rigid nature to it, and cushions and protects the glass strands and filaments from corrosion by water and other elements in the roadway environment. The impregnation also reduces abrasion between glass strands or filaments and the cutting of one glass strand or filament by another. The impregnation also reduces the tendency of the glass fibers to cut each other, which is particularly important after the grid has been laid down but before the overlayment has been applied.

The grid should preferably have a minimum strength of 25 kiloNewtons per meter (kN/m) in the direction of each set of parallel strands, more preferably 50 kN/m and most preferably 100 kN/m or more.

While drying or curing the resin on the grid, the strands may be somewhat flattened, but the grid-like openings are maintained. For example, in a preferred embodiment using 2200 tex rovings, a rectangular grid was formed, with openings of about ¾ inch by one inch, and the rovings flattened to about 1/16 inch to ⅛ inch across. The thickness of the rovings after coating and drying was about 1/32 inch or less.

Many resins can be used for impregnating the grid, provided they are such that adhesives can be bonded to them well. Primary examples are asphalt, rubber modified asphalt, unsaturated polyesters, vinyl ester, epoxies, polyacrylates, polyurethanes, polyolefines, and phenolics which give the required rigidity, compatibility, and corrosion resistance. They may be applied using hot-melt, emulsion, solvent, thermal-cure or radiation-cure systems. For example, a 50% solution of 120°-195° C. (boiling point) asphalt was dissolved in a hydrocarbon solvent using a series of padding rollers. The material was thermally cured at 175° C. at a throughput speed of 30 feet/min. The pick-up of asphalt material was 10-15% based on original glass weight. Alternatively, an asphaltic emulsion modified with a polymeric material, such as an acrylic polymer, can be padded onto the grid and thermally cured. Such modification of the asphalt makes it possible to achieve a coating which is less brittle at low temperatures.

After the grid is pre impregnated with resin, and before it is laid in place on the paving, a very stable activatable adhesive coating is applied to the grid. That is to say, the adhesive is "pre-applied."

The adhesive is preferably a synthetic material and may be applied to the resin impregnated grid in any suitable manner, such as by use of a latex system, a solvent system, or preferably a hot melt system. In a latex system the adhesive is dispersed in water, printed onto the grid using a gravure print roll, and dried. In a solvent system, the adhesive is dissolved in an appropriate solvent, printed onto the grid, and then the solvent is evaporated. In the preferred hot melt system, the adhesive is melted in a reservoir, applied to a roll, and metered on the roll with a closely controlled knife edge to create a uniform film of liquid adhesive on the roll. The grid is then brought into contact with the roll and the adhesive transferred to the grid.

Whatever system of application is used, it is highly preferable to have the adhesive located on only one side cf the grid. If the adhesive is applied to both sides, or if it bleeds through from one side of the grid to the other, then the upper surface when laid on an underlayment will stick to paving vehicles, personnel, and rolling equipment, creating numerous problems including distortion of the grid.

It is also desirable to apply the adhesive to only a portion of the surface of the strands, preferably to about only 20 to 60% of the surface area of the strands, and most preferably to only 30 to 50%. Not only is this more economical, but it also facilitates unrolling at the time of installation on a paving surface. In order to apply the adhesive to only a portion of the strands, one may use an engraved roll to pick-up the adhesive and transfer it to the grid. The adhesive preferably appears as daubs on the strands of the grid. We have found that by using such daubs it is possible to fixedly adhere the grid to rough and porous underlayment layers with the desired adhesive strength. The amount of adhesive added is preferably between about 5% and about 10% by weight of the grid, most preferably about 5%.

The adhesive must be very stable, which means that it preferably should have the following properties. After the adhesive is applied to the grid, the combination should preferably be storable for more than one year. During that period the adhesive should not significantly degrade, lose its adhesive properties, or otherwise suffer any deleterious chemical change, either by reason of interaction with the resin impregnating the grid, such as volatiles from the resin penetrating the adhesive and destroying its properties, atmospheric oxidation, or other deleterious reactions. In addition, the adhesive should not significantly leach or penetrate into the impregnated grid, and the adhesive must be sufficiently viscous at storage temperatures and conditions that it tends to retain its shape and resists stain or other deformation after being rolled up under tension. Further, the adhesive should be substantially stable and compatible with asphaltic cement or concrete during and after installation.

The impregnating resins and the adhesives of this invention have the advantage that they may both be applied in a factory. This makes it possible to maintain uniformity and control to a much better degree than could be done when they are applied at the paving site, which is usually outdoors and subject to changes in temperature, humidity, and drying rates. Furthermore, better controls, as well as personnel with better skills in the application of resins and adhesives, may be found in a factory. It is of course not necessary that the resin and the adhesive be applied at the same time or even at the same factory.

Many kinds of adhesives having appropriate properties may be used in the present invention, preferably synthetic elastomeric adhesives and synthetic thermoplastic adhesives, and most preferably synthetic elastomeric adhesives. Included among these are acrylics, styrene-butadiene rubbers, tackified asphalts, and tackified olefins.

The adhesives of the present invention are activatable by pressure, heat, or other means. A pressure activatable adhesive, sometimes called a pressure sensitive adhesive, forms a bond when a surface coated with it is brought into contact with a second untreated surface and pressure is applied. A heat activatable resin forms a bond when a surface coated with it is brought into contact with an untreated surface and heat is applied.

The adhesives of this invention must have a proper balance of properties. As described in detail below, if the adhesive is a pressure sensitive one, it should have a high degree of tack in order to adhere to the often uneven surface of the underlying paving. Any adhesive used must also have high shear strength, but its peel strength must not be too high. At the same time, it is preferable that cohesive strength exceed adhesive strength. Viscosity and softening point must also be considered.

Pressure Sensitivity

Tack is the property of a material which causes it to adhere to another and can be defined as the stress required to break bonds between two surfaces in contact for a short period of time. The tack for adhesives of this invention at the time of application to the grid is preferably greater than 700 and most preferably greater than 1000 gm/cm$^2$ as measured by the Polyken Probe Tack Test under the following conditions: clean surface material, stainless steel with a 4/0 finish washed with acetone; size of clean surface, 1 square centimeter; force at which clean surface impinges adhesive, 100 gm/cm$^2$; thickness of adhesive, 1 mil (0.001 inch) laid on a 2 mil polyethylene terephthalate film such as Mylar® film; temperature, 72° F. at 50% humidity; contact time of surface before removal, 1 second; rate of removal of surface, 1 cm/sec. The maximum force in grams on removal is the test result.

Pressure sensitive adhesives are preferable because they retain their tack over long periods of time. For purposes of the present invention, substantial tack must be maintained for loner than one year in storage.

Cohesive Strength

Adhesives for use in this invention preferably have a cohesive strength which is greater than their adhesive strength. Cohesive strength refers to the strength of the adhesive to hold itself together. Adhesive strength refers to the strength of the adhesive to adhere to an untreated surface. By keeping the cohesive strength higher than the adhesive strength, the adhesive is not transferred from one surface of the grid while the grid is rolled. Thus, one surface of the grid may be kept free of adhesive, and the adhesive does not adhere to paving vehicles or personnel who travel on top of the grid while applying the asphaltic overlayment layer.

Peel Strength

It is also preferable that the peel strength of the adhesives of this invention be kept as low as possible consistent with other requirements. Peel strength is the force, in pounds per inch of width of bond, required to strip a flexible member of a bonded strip from a second member. An adhesive with too great a peel strength would require undue force to unroll the grid or to separate two grid layers stored in contact with each other. Moreover, if the peel strength is too great, grids may be distorted in the process of separating them. On the other hand, there must be some tackiness in the adhesive at the low temperatures at which it may be applied. We therefore prefer to use an adhesive which has sufficient peel strength to resist peeling in the following "peel test" procedure: A 2"×15" strip of grid, coated with adhesive, is laid without pressure on a horizontal piece of drywall and a 2 kilogram roller is immediately passed over it twice; the drywall is then inverted so that the grid is on the lower surface, a three inch portion of the grid is peeled off, and a 75 gram weight is suspended from that portion. After 6 minutes at 32° F. preferably none of grid is pulled away by the 75 gram weight.

Shear Strength

Once the grid is in place on the paving underlayment, it must resist the action of workmen walking on it, construction vehicles traveling over it, and particularly the movement of the paving machine over it. In addition, it is highly important to the strength of the paving that the reinforcement remain flat, with its strands in parallel alignment. Any bubbles in the grid or sideways distortion of the strands tends to reduce the strength of the reinforcement, which is at its strongest when the strands are straight and uniaxial and each set of strands lies its own plane.

It is therefore highly desirable that the shear strength be as high as possible, and that the shear strength be substantial over the extremely broad range of temperatures to which the grid will be subjected. The grid may be installed on paving underlayments at ambient temperatures as low as about 40° F., and asphaltic concretes may be applied at temperatures of about 300° F., raising the adhesive temperature to about 150° F. We therefore prefer that adhesives to be used in this invention have a shear adhesion failure temperature ("S.A.F.T.") of greater than about 140° F., or more preferably greater than 150° F. S.A.F.T. is measured by applying a 1 kilogram force in the plane of the surface of a one inch by one inch plate adhered by the adhesive to another surface in a circulating air chamber whose temperature is raised 40° F. per hour beginning at 100° F. The S.A.F.T. of an adhesive is the temperature at which that surface slides off the adhesive, indicating a weakening of the shear properties of the adhesive.

We also prefer that the shear strength of adhesive be such that it imparts to the grid as it is placed on the paving underlayment a shear strength at least 30 pounds and preferably more than 50 pounds measured as follows: A grid 1.52 meters wide (direction of weft), 1 meter in length (direction of warp), and coated with adhesive in accordance with this invention is applied to a paving and the adhesive is activated, for example by applying pressure if the adhesive is pressure sensitive; a spring scale is hooked or otherwise attached to one lengthwise edge of the grid at least three warp strands in from the edge; force is applied to the scale in the plane of the grid and perpendicular to the length of the grid; and the force at which the grid slips is recorded.

Softening Point

The adhesive should also have a softening point preferably above 140° F. and more preferably above 150° F.

Viscosity

The viscosity of the adhesive is also important. It must be sufficiently fluid to flow onto the grid, but preferably is sufficiently viscous that it does not flow through the grid during application or storage but rather stays on the side of the grid which will come into contact with the paving underlayment when the grid is laid. We prefer an adhesive which is lower in viscosity than 7000 cp and most preferably one that is below 5000 cp at 300° F.

EXAMPLE 1

A warp knit, weft inserted structure is prepared using 2200 tex rovings of continuous filament fiberglass in both the machine and cross-machine directions, each roving having about 1000 filaments and each filament being about twenty microns in diameter. These rovings are knit together using 70 denier continuous filament polyester yarn into a structure having openings of 10 millimeters ("mm") by 12.5 mm. Weft yarns are inserted only every fifth stitch. The structure is thereafter saturated using a padding roller equipped to control nip pressure with a 50% solution of asphalt (Gulf Oil Company designation PR-19-61) dissolved in high boiling point aliphatic cut hydrocarbon solvent and thermally cured at 175° C. on steel drums using a throughput speed of 30 feet per minute. This thorough impregnation with asphalt serves to protect the glass filaments from the corrosive effects of water, particularly high pH or low pH water which is created by the use of salt on roads, and to reduce friction between the filaments, which can tend to break them and reduce the strength of the yarn. The asphalt pickup is about 10 to 15% based on the original glass weight. The resulting grid weighs about 300 grams per square meter and has a tensile strength across the width of 100 kiloNewtons per meter and across the length of 100 kiloNewtons per meter. The modulus of elasticity is about 10,000,000 pounds per square inch, and the grid could be rolled and handled with relative ease.

Thereafter, a styrene isoprene-styrene polymer adhesive having the following properties is applied to one side of the grid using a hot melt method.

| | |
|---|---|
| Polyken Probe Tack | 1440 gm/cm$^2$ |
| Shear Adhesion Failure Temperature | 157° F. |
| Softening Point | 185° F. |
| Melting Point | 210° F. |
| Static Peel Test at 32° F. | passes |
| Viscosity at 300° F. | 5700 cp |
| Shear force of grid on road | greater than 50 pounds. |

This grid is then rolled into a cylindrical shape and may be applied to an asphaltic concrete road surface which has significant cracking but is structurally sound, as follows. Normal surface preparation is performed, including base repairs, crack sealing, and pothole filling. The grid is unrolled on the surface, then pressed against the underlying pavement by laying the self-adhesive grid over the base with an applicator. This applicator places the grid, adhesive side down, and applies pressure with brushes. An additional roller with pneumatic tires is desirable to achieve even better adhesion. Thereafter about 50 mm of HL 1 asphaltic concrete is applied using conventional equipment and techniques.

The resulting reinforcement layer with the reinforcing grid is effective in reducing the occurrence of reflective cracks in the overlay.

I claim:

1. A process for making a reinforcement for asphaltic paving comprising:

selecting an open grid comprising two sets of parallel strands of continuous filament fibers, the grid having openings between adjacent strands and the two sets of strands being substantially perpendicular to each other;

impregnating the strands of the grid with a resin; and applying to one side of the resin-impregnated grid a coating of stable, activatable adhesive without closing the openings between the strands, the adhesive being compatible with asphaltic paving.

2. The process of claim 1, wherein the adhesive coating is applied to a portion of the one side of the resin-impregnated grid.

3. The process of claim 2, wherein the adhesive is applied to about 20 to 60% of the surface area of the one side.

4. The process of claim 2, wherein the adhesive is applied to about 30 to 50% of the surface area of the one side.

5. The process of claim 2, wherein the adhesive is applied to about 5% to 10% by weight of the grid.

6. The process of claim 1, further comprising applying the adhesive coating to the grid primarily for the purpose of being activated for forming a tack coat free bond compatible with asphaltic paving.

7. The process of claim 1, wherein the impregnated grid has a strength of at least 25 kiloNewtons per meter in the direction of each set of parallel strands.

8. The process of claim 1, wherein further comprising selecting as the continuous filament fibers, low-twist glass fibers ranging in weight from about 300 to about 5000 tex.

9. The process of claim 1, wherein the openings in the grid are substantially rectangular and are between about ⅛ inch to about six inches on a side.

10. The process of claim 1, further comprising affixing the strands of the grids at intersections of crosswise and lengthwise strands before impregnating the grid with resin.

11. The process of claim 10, wherein the affixing step comprises stitching grid intersections together by warp-knit, weft-insertion knitting using 70 to 150 denier polyester.

12. The process of claim 1, wherein the grid weighs between approximately 4 and 18 ounces per square yard.

13. The process of claim 1, wherein the grid is non-woven.

14. The process of claim 13, further comprising affixing grid intersections with adhesive.

15. The process of claim 1, wherein the impregnating resin is compatible with asphaltic paving.

16. The process of claim 15, wherein the impregnating resin is selected from the group consisting of asphalt, rubber modified asphalt, unsaturated polyesters, vinyl ester, epoxies, polyacrylates, polyurethanes, polyolefines and phenolics.

17. The process of claim 1, wherein the activatable adhesive is a synthetic material.

18. The process of claim 17, wherein the synthetic activatable adhesive is selected from synthetic elastomeric and synthetic thermoplastic adhesives.

19. The process of claim 1, wherein the activatable adhesive has a tack at the time of application to the grid greater than about 700 $gm/cm^2$.

20. The process of claim 1, wherein the activatable adhesive has a tack at the time of application to the grid greater than about 1000 $gm/cm^2$.

21. The process of claim 1, wherein the activatable adhesive has a cohesive strength greater than its adhesive strength.

22. The process of claim 1, wherein the activatable adhesive has a shear adhesion failure temperature greater than about 140° F.

23. The process of claim 1, wherein the activatable adhesive is applied to the grid to impart a shear strength to the grid of at least 30 pounds when applied to a paving surface.

24. The process of claim 1, wherein the activatable adhesive has a softening point greater than about 140° F.

25. The process of claim 1, wherein the activatable adhesive has a viscosity lower than about 7000 cp at about 300° F.

26. The process of claim 1, wherein the activatable adhesive has a viscosity lower than about 5000 cp at about 300° F.

* * * * *

UNITED STATES PATENT AND TRADEMARK OFFICE

CERTIFICATE OF CORRECTION

PATENT NO. 5,110,627

DATED May 5, 1992

INVENTOR(S) Roy Shoesmith, et al.

It is certified that error appears in the above-identified patent and that said Letters Patent is hereby corrected as shown below:

On title page, item [56],

Under "OTHER PUBLICATIONS"

Line 1, "fiberglas" should read --Fiberglas--; and
Line 3, "Fiberlgas" should read --Fiberglas--.

COLUMN 4

Line 8, "rid" should read --grid--; and
Line 12, "square" should read --square yard--.

COLUMN 5

Line 4, "pre impregnated" should read --pre-impregnated--;
Line 9, "resin impregnated" should read --resin-impregnated--; and
Line 24, "cf" should read --of--.

UNITED STATES PATENT AND TRADEMARK OFFICE

CERTIFICATE OF CORRECTION

PATENT NO. 5,110,627

DATED May 5, 1992

INVENTOR(S) Roy Shoesmith, et al.

It is certified that error appears in the above-identified patent and that said Letters Patent is hereby corrected as shown below:

COLUMN 9

Line 11, "I claim:" should read --We claim:--.

Signed and Sealed this

Third Day of August, 1993

Attest:

Michael K. Kirk

MICHAEL K. KIRK

Attesting Officer

Acting Commissioner of Patents and Trademarks